United States Patent [19]

Motobayashi et al.

[11] 4,041,687

[45] Aug. 16, 1977

[54] DEVICE FOR REMOVING IMPURITIES SEPARATED FROM FIBERS IN OPEN END SPINNING UNIT

[75] Inventors: Kozo Motobayashi, Aichi; Takeshi Shimizu; Noriaki Miyamoto, both of Kariya, Japan

[73] Assignees: Kabushiki Kaisha Toyoda Jidoshokki Seisakusho; Daiwa Boseki Kabushiki Kaisha, both of Japan

[21] Appl. No.: 671,694

[22] Filed: Mar. 29, 1976

[30] Foreign Application Priority Data

Apr. 2, 1975 Japan ..... 50-40679

[51] Int. Cl.[2] ..... D01H 1/12; D01H 11/00

[52] U.S. Cl. ..... 57/56; 57/58.89

[58] Field of Search ..... 57/56, 58.89–58.95

[56] References Cited

U.S. PATENT DOCUMENTS

| | | | |
|---|---|---|---|
| 3,777,466 | 12/1973 | Kabele et al. | 57/58.95 X |
| 3,792,575 | 2/1974 | Doudlebsky et al. | 57/56 |
| 3,800,521 | 4/1974 | Doudlebsky et al. | 57/58.95 |
| 3,839,764 | 10/1974 | Clayton | 57/56 X |
| 3,884,027 | 5/1975 | Schumann et al. | 57/56 |
| 3,884,028 | 5/1975 | Stahlecker et al. | 57/56 |
| 3,892,063 | 7/1975 | Doudlebsky et al. | 57/58.95 X |
| 3,924,397 | 12/1975 | Stahlecker et al. | 57/56 |
| 3,959,961 | 6/1976 | Stahlecker | 57/56 |

*Primary Examiner*—John Petrakes

*Attorney, Agent, or Firm*—Wenderoth, Lind & Ponack

[57] ABSTRACT

An open-end spinning machine has a succession of spinning units mounted on the frame thereof for pivotal movement between operative and inoperative positions, each spinning unit including a silver opening section, which contains therein a combing-out zone and a doffing zone. The silver opening section is associated with an impurity collecting chamber having an impurity inlet port arranged to be in communication with a fiber path between the combing-out zone and the doffing zone, and an impurity outlet port, through which the impurities are discharged from the collecting chamber. The outlet port has an open end opening into the atmosphere, and an impurity transfer pipe connected at one end to a source of vacuum is arranged so that the other end thereof faces the open end of the outlet port in spaced relation thereto. In order to restrict the amount of air flowing through the spacing between the open end of the outlet port and the other end of the transfer pipe, a restricting flange is attached to the other end of the transfer pipe.

7 Claims, 7 Drawing Figures

DEVICE FOR REMOVING IMPURITIES SEPARATED FROM FIBERS IN OPEN END SPINNING UNIT

BACKGROUND OF THE INVENTION

This invention relates generally to an open-end spinning machine of the type comprising a succession of spinning units mounted on the frame thereof for pivotal movement between operative and inoperative positions, and particularly to an impurity removing device provided for each spinning unit of the spinning machine of the type described.

In the spinning unit of the type described above, there is a sliver opening section containing a combing-out zone and a doffing zone and associated with an impurity collecting chamber. The chamber has an impurity inlet port arranged to be in communication with a fiber path between the combing-out zone and the doffing zone, and an impurity outlet port through which the impurities, such as crushed husks, leaves, stems, seeds dust, buds and short fibers are discharged from the chamber. The outlet port is integrally connected to an impurity transfer pipe, which is in turn connected to a source of vacuum.

Such an integral connection of the outlet port to the impurity transfer pipe not only makes it difficult to assemble the spinning unit, but requires the spinning unit to be manufactured with very great precision.

Furthermore, the integral connection of the impurity transfer pipe creates the problem that the transfer pipe is subject to a bending or expanding force whenever the spinning unit is swung between the operative and inoperative positions. This will not only shorten the life of the transfer pipe, but cause the connection thereof to be damaged. In addition, when it is desired to remove the spinning unit from the spinning machine, the transfer pipe must be disconnected from the impurity outlet port. This is very troublesome.

It is therefore a principal object of the invention to provide a device for removing impurities separated from fibers opened up in a spinning unit of a spinning machine, which device eliminates the above-described disadvantages of the prior art, that is, causes no bending or expanding force to be imposed on the impurity transfer pipe when the spinning unit is inclined into an inoperative position and returned to an upright operative position, and allows the spinning unit to be dismounted from the frame without necessitating a disconnection of the impurity transfer pipe.

BRIEF DESCRIPTION OF THE DRAWINGS

The invention will become more readily apparent from the following detailed description taken in conjunction with the accompanying drawings in which.

DESCRIPTION OF THE PREFERRED EMBODIMENTS

A detailed description of the prior art will be given hereinafter in conjunction with FIGS. 1 and 2 to facilitate the understanding of the present invention.

Figure 1:
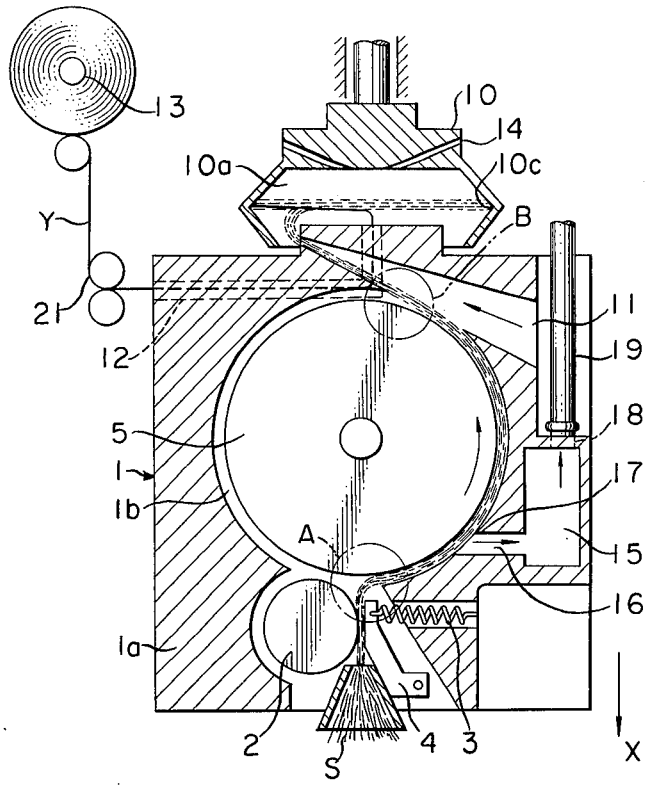
FIG. 1 PRIOR ART
FIG. 1 is a section of a prior art spinning unit of an open-end spinning machine.

Referring to FIG. 1, there is shown a prior art spinning unit 1 of an open-end spinning machine. A sliver S of staple fibers enters a body 1*a* of the spinning unit 1 through a condensing funnel and is pressed against a feeding roller 2 by a pressure shoe 4 normally urged toward the feeding roller 2 by a spring 3. The sliver S is passed to a combing roller 5 with a fiber gripping surface, which opens it up into individual fibers. From a combing-out zone A, the fibers are transported by the combing roller 5 through an arcuate fiber transfer path, which is defined by the fiber gripping surface of the combing roller 5 and the wall of a recess 1*b* provided in the body 1*a*, to a doffing zone B, from which the fibers pass through a channel 11 into a spinning chamber 10*a* of a rotor 10 with a flow of suction air (shown by the arrow) generated in the channel 11 due to the rotation of the rotor 10. In the spinning chamber 10*a*, the fibers form a ring in a maximum diameter portion 10*c* thereof due to centrifugal force and are transformed to a spun yarn Y in a known way by the open-end method and withdrawn from the spinning chamber 10*a* through a guide duct 12 by means of a draw-off device 21. The yarn Y is wound on a winding roller 13. The flow of suction air, which transferred the fibers into the spinning chamber 10*a*, comes out of the spinning rotor 10 through discharge openings 14 provided therein. The sliver supply section of the spinning unit 1 is formed by the pressure shoe 4 and the feeding roller 2, and the opening section of the spinning unit comprises the combing roller 5. The feeding roller 2, the combing roller 5 and the rotor 10 can be rotated by suitable driving mechanisms, respectively, which may be of conventional designs and therefore are not illustrated in the drawings.

An impurity removing device comprises an impurity collecting chamber 15 provided in the body 1*a* so as to open through a separating duct 16 into the arcuate transfer path between the combing-out zone A and the doffing zone B. During the opening operation by the opening roller 5, impurities in the individual fibers, such as those denser than the fibers, are thrown out by centrifugal force and leave the fibers and flow through the separating duct 16 into the collecting chamber 15. The impurities in the chamber 15 are intermittently or successively discharged, by suction, out of the chamber 15 through an impurity transfer pipe 19 integrally connected at one end to a not shown source of vacuum and at the other end to an impurity outlet port 18 of the chamber 15. Such an integral connection of the transfer pipe 18 with the impurity outlet port 18 makes it difficult to assemble the spinning unit 1 and requires a very high precision in manufacturing the same.

Figure 2:
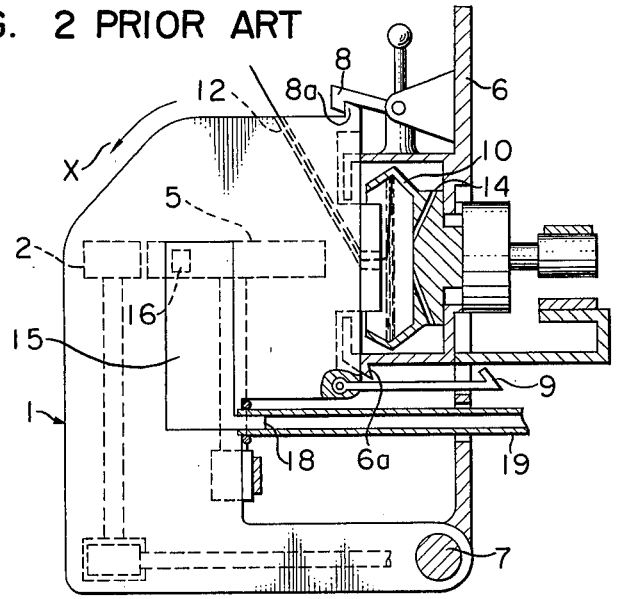
FIG. 2 PRIOR ART
FIG. 2 is an elevational view, partly in section, of the spinning unit of FIG. 1 attached to a frame of the spinning machine.

As shown in FIG. 2, the spinning unit 1 described above is mounted for swinging motion on a frame 6 in a manner that its lower portion is pivotally supported through a pin 7 by the frame 6 and the upper portion is engaged at its upwardly extending projection 8*a* by a hook 8 pivotally mounted on the frame 6. Therefore, the spinning unit 1 can swing in a direction X about the pin 7 when the engagement between the hook 8 and the projection 8*a* is broken. Where the spinning unit 1 is in the swung position, in which it is inoperative and the over-swinging thereof is prevented by the engagement of a hook 9 pivotally mounted on the spinning unit 1 with a projection 6a of the frame 6, the rotor 10 is exposed to the surrounding atmosphere so that unnecessary fibers in the spinning chamber 10a can be removed, and structural elements forming the spinning unit 1 can be replaced with new ones. However, since the impurity transfer pipe 19 is integrally connected to the outlet port 18 of the collecting chamber 15 as described hereinbefore, it will be subject to expanding and bending actions upon the swinging movement of the spinning unit 1 into the inoperative position and upon the return movement of the same to the operative position shown in FIG. 2. In addition, when removing the spinning unit 1 from the spinning machine, a troublesome operation is required to disconnect the tranfer pipe 19 from the outlet port 18.

Thus, it will be understood that, in the spinning unit of the type shown in FIGS. 1 and 2, the above-mentioned disadvantages should be eliminated.

Figure 3:
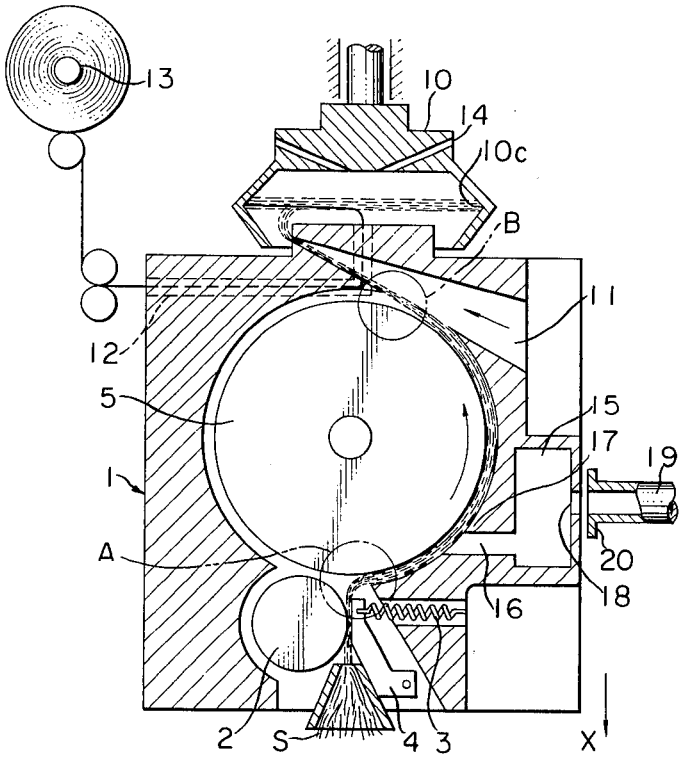
FIG. 3 is a sectional view, corresponding to FIG. 1, of a spinning unit according to the present invention.

Preferred embodiments according to the invention are illustrated in FIGS. 3 to 7. Various elements of FIGS. 3 to 7, corresponding to similarly operating elements of FIGS. 1 and 2, are designated by the same reference numerals. Movements of the fibers passing through a spinning unit 1 illustrated in FIG. 3 are the same as those of the fibers in FIG. 1 and the description thereof can be omitted. Also, all of the structural elements of the embodiments of FIGS. 3 to 7 are similar to those of FIGS. 1 and 2 with the exception of the impurity transfer pipe. Therefore, descriptions of these structural elements are given briefly.

In FIG. 3, an impurity collecting chamber 15 is provided in a body 1a of the spinning unit 1. The chamber 15 may be formed by a suitable member (not shown) separately from the body 1a. As shown in FIG. 3, the upper portion of the chamber 15 is in communication with a separating duct 16, which opens into a fiber transfer path defined between a combing-out zone A and a doffing zone B. Impurities in the fibers opened up by a combing roller 5 are separated from the fibers by centrifugal force and caused to enter the separating duct 16 with the help of an edge 17 provided on one end of the separating duct 16 and pass through the separating duct 16 into the collecting chamber 15.

Figure 4:
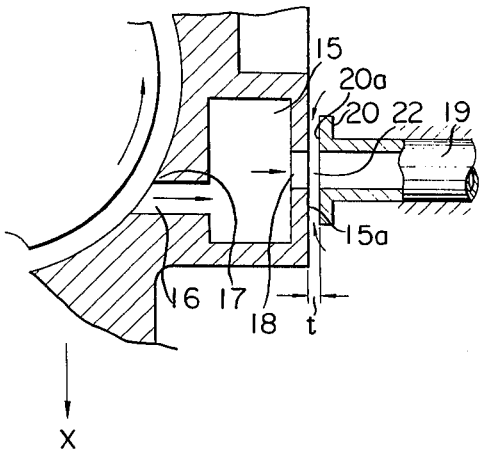
FIG. 4 is an enlarged sectional view of the essential parts shown in FIG. 3.

As best shown in FIG. 4, the lower portion of the chamber 15 is provided with an impurity discharge opening 18, which has inner and outer opposed ends opening into the collecting chamber 15, and the free surrounding atmosphere, respectively. The outer end of the impurity discharge opening 18 faces in spaced relation an impurity transfer pipe 19 connected with a not shown source of vacuum, so that the impurities in the collecting chamber 15 are successively or intermittently sucked into and discharged out of the collecting chamber 15 by the flow of suction air passing through the pipe 19. Around the open end of the transfer pipe 19 adjacent to the outer end of the discharge opening 18, there is means for restricting the amount of air flowing into the transfer pipe 19 through the gap 22 formed between the surface 15a of the body 1a around the outer end of the discharge opening 18 and the free end of the transfer pipe 19. The restricting means comprises a flanged portion 20 of the end of the transfer pipe 19, which portion has a circular or rectangular periphery. However, the flanged portion 20 may have any other suitable shape. The gap 22 between the surface 15a of the wall of the collecting chamber 15, in which the discharge opening 18 is provided, and the surface 20a of the flanged portion 20 opposed to the surface 15a has a suitable width *t* so that the transfer pipe 19 is maintained in communication with the discharge opening 18 without contact with the surface 15a. During the impurity discharge operation, there is a possibility that air will flow through the gap 22 into the transfer pipe 19. However, it is to be noted that only a small amount of air is allowed to enter the transfer pipe 19, because the wall surface 15a of the collecting chamber 15 cooperates with the surface 20a of the flanged portion 20 to restrict the flow of air.

That is, the surfaces 15a and 20a of the collecting chamber 15 and the flanged portion 20 function as an orifice or means for controlling the flow of air through the gap 22. If the width *t* of the gap 22 is maintained constant, the more the total area of the opposed surfaces 15a and 20a increases, the more resistance is imposed on the flow of air through the gap 22, thus restricting the flow of air. Therefore, according to the invention, the total area is so selected that the rate of air inflow through the gap 22 is limited to the extent that the presence of the orifice does not hinder the impurity transfer action of the transfer pipe 19. Such a total area makes it possible to favorably transfer the impurities in the collecting chamber 15 through the discharge opening 18 and the transfer pipe 19, even if the transfer pipe 19 has no contact with the surface 15a of the wall around the discharge opening 18.

It will be understood that the contactless communication between the discharge port 18 and the transfer pipe 19 advantageously eliminates the need for disconnecting the transfer pipe 19 from the discharge port 18, which has been absolutely required in the prior art spinning units, when the spinning unit 1 is inclined forwards (in the direction X) about the support pin 7 in order to clean out the rotor 10, for example, upon the occurrence of a yarn breakage, and when the spinning unit 1 has to be removed from the frame 6 in order to make an exchange of parts of the spinning unit 1. In addition, if the spinning unit 1 is restored to the operative position (shown in FIG. 2) after the removal of the unnecessary fibers from the spinning chamber 10a and/or after the exchange of the parts, then the discharge port 18 of the collecting chamber 15 is automatically brought into alignment and contactless communication with the transfer pipe 19. It will therefore be understood that the transfer pipe 19 is securely mounted in a predetermined position on the frame 6 so that it communicates with the collecting chamber 15 when the spinning unit 1 is in the operative position (in which the spinning section 10 is in operative engagement with the opening section 5) and it is separated far from the discharge port 18 when the spinning unit 1 is in the inoperative position (in which the unit is inclined in the direction X).

Figure 5:
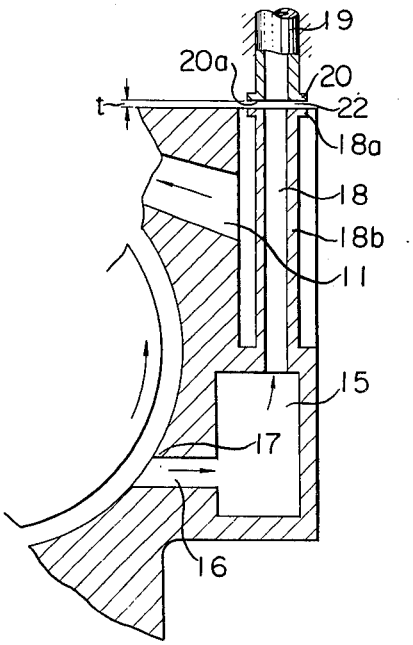

FIG. 5 is a view corresponding to that of FIG. 4, showing a different modification of the invention, wherein a discharge opening 18 having a considerable length opens into the free surrounding atmosphere at one side of a spinning unit. The discharge opening 18 is defined by a tubular member, which may or may not be an integral portion of a body 1a of the spinning unit, with a flanged end 18a. Flanged ends 18a and 20 are spaced apart a predetermined distance *t* and have diameters sufficient to provide a total surface area which favorably limits the amount of air flowing through the gap 22 as desired.

Figure 6:
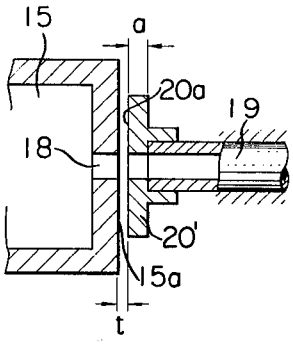
FIGS. 5 to 7 are sectional views corresponding to FIG. 4, but showing different modifications of the invention.
Figure 7:
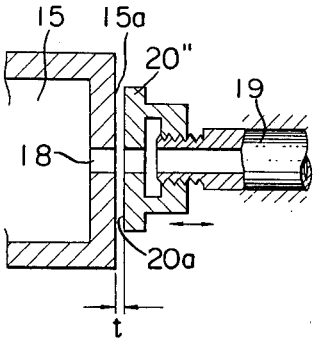

FIGS. 6 and 7 show further different modifications of the invention, each of which is designed to allow the width *t* of a gap 22 to be adjusted. In FIG. 6, one of a plurality of interchangeable flanged members 20', which differ in the thickness *a* of flange portions thereof from one another, is disconnectably fitted onto one end of the transfer pipe 19. In the embodiment of FIG. 7, a flanged member 20'' is screw threaded onto one end of the transfer pipe 19 to provide a predetermined width of gap and thereafter is fixed by a not shown set-screw. The flanged members 20' and 20'' make it easier than the flange 20 shown in FIGS. 3–5 to obtain the desired width of gap 22.

From the foregoing, it is apparent according to the invention that the impurity transfer pipe faces the impurity discharge port of the collecting chamber with the predetermined gap therebetween and is provided, around the end thereof opposite to the impurity discharge port, with means for restricting the inflow of air through the gap into the transfer pipe, whereby the contactless communication is provided between the impurity discharge port and the impurity transfer pipe without hindering the impurity transfer function of the transfer pipe. This is profitable, as compared with the prior art contact communication of the transfer pipe with the discharge port, for the assembling and manufacturing of the spinning unit and the impurity transfer pipe. In addition, when mounting and demounting the spinning unit on and from the framed construction, there is no need for connecting or disconnecting the impurity transfer pipe to or from the collecting chamber. This not only makes the mounting and demounting operation of the spinning unit easier, but eliminates abrasion of the opposed end surfaces of the discharge port and transfer pipe. Therefore, according to the invention, the amount of air flowing through the gap into the impurity transfer pipe is always maintained constant. This produces the advantage that the impurity transferring ability of the transfer pipe is maintained unchanged.

Although various specific embodiments have been described above, it will be readily understood by those skilled in the art that various rearrangements of parts and modifications of parts may be accomplished without departing from the spirit and scope of the invention.

What we claim is:

1. A device for removing impurities separated from individual fibers opened up in a spinning unit of an open-end spinning machine, which has the spinning unit mounted on a frame thereof for movement between an operative position and an inoperative position, the spinning unit including a sliver supply section, and a sliver opening section combing out a sliver from the sliver supply section into the individual fibers, the impurity separating device comprising:

an impurity collecting chamber provided in the spinning unit in communication with the sliver opening section so that the impurities separated from the individual fibers enter the chamber;

a first passageway provided in the spinning unit for allowing the impurities in the chamber to come out thereof, the first passageway having an inner end opening into the chamber and an outer end opening into the atmosphere surrounding the spinning unit at all positions of said spinning unit;

a source of vacuum;

a second passageway fixedly mounted on the frame of the spinning machine and having one end connected to said source of vacuum and having the other end spaced from the outer end of the first passageway in all positions of the spinning unit; and means for providing a predetermined gap between the outer end of the first passageway and the other end of the second passageway when the spinning unit is in the operative position, said means comprising a pair of surfaces defining a gap between said outer end and said other end and spaced from each other at a distance and having a total surface area for causing air flowing through the gap into the second passageway to encounter sufficient resistance to limit the amount of air flowing therethrough to an amount below a predetermined level, whereby the impurities in the chamber are removed therefrom through the disconnected first and second passageways.

2. The device defined in claim 1, wherein the spinning unit has a body in which the sliver supply section and the sliver opening section are provided, and said impurity collecting chamber and the first passageway are in said body of the spinning unit.

3. The device defined in claim 2, wherein the end of the second passageway positioned near the outer end of the first passageway is a flanged end, and said surface on said other end of said second passageway is the surface of the flanged end opposed to said first passageway.

4. The device defined in claim 3, wherein the outer surface of the body is flush with the outer end of the first passageway and opposed to the flanged end of the second passageway and constitutes said surface on the end of said first passageway.

5. The device defined in claim 1, wherein the outer end of the first passageway is a flanged end, and said surface on said outer end of said first passageway is the surface of the flanged end opposed to said second passageway.

6. The device defined in claim 1, wherein said second passageway has a flanged cylindrical member detachably connected to the said other end with the surface of the flanged cylindrical member facing the outer end of said first passageway constituting the one of said pair of surfaces on said second passageway.

7. The device defined in claim 6, wherein the flanged member is screw threaded to the said other end of said second passageway for adjustment toward and away from the outer end of said one passageway.

* * * * *